United States Patent [19]

Shoemaker

[11] 3,985,355

[45] Oct. 12, 1976

[54] GAME

[76] Inventor: Donald Shoemaker, 2933 48th Court, Cicero, Ill. 60650

[22] Filed: Apr. 21, 1975

[21] Appl. No.: 570,238

[52] U.S. Cl. ..... 273/3 A; 273/125 R

[51] Int. Cl.[2] ..... A63D 15/00

[58] Field of Search ..... 273/3, 22, 123, 125; 108/150, 157, 159; 248/188.7, 164, 431, 432; D34/3

[56] References Cited

UNITED STATES PATENTS

| | | | |
|---|---|---|---|
| 1,207,905 | 12/1916 | Hallam | 273/123 R |
| 2,235,290 | 3/1941 | Exline et al. | 108/159 |
| 2,262,610 | 11/1941 | Kellerman | 273/3 R |
| 2,825,565 | 3/1958 | Hooker | 273/125 A |
| 3,672,671 | 6/1972 | Merola | 273/22 |
| 3,825,258 | 7/1974 | Frierman | 273/22 X |

*Primary Examiner*—Paul E. Shapiro

[57] ABSTRACT

A game making use of a cruciform table having at each extremity a pocket marked with a different color, in which a plurality of balls, similar to billiard balls, are provided for use by up to four persons, the balls being of a distinctive color for each player, and in which a multiplicity of cushions are provided for effecting complex shots, the object being to strike the balls of a particular color with a cue ball impelled by a cue stick so that all the balls of a particular color are dropped into the pocket of corresponding color.

7 Claims, 5 Drawing Figures

GAME

SUMMARY OF THE INVENTION

A pool table or the like of cruciform configuration with a pocket at each extremity, each extremity being substantially square in configuration and being joined to the adjacent extremity by an angular wall coincident with and co-planar with an imaginary line extending from the corner of one extremity to the opposite corner of the adjacent corner thereby forming a substantially square central area, the joining walls being cushioned to cooperate with cushions in the walls of each extremity to produce multi-contact cushion shots. The table of the present game is provided with a pair of notched legs, each containing a trough for reception of the balls of two colors in a readily excessible receptacle.

DESCRIPTION OF THE PREFERRED EMBODIMENTS

Figure 1:
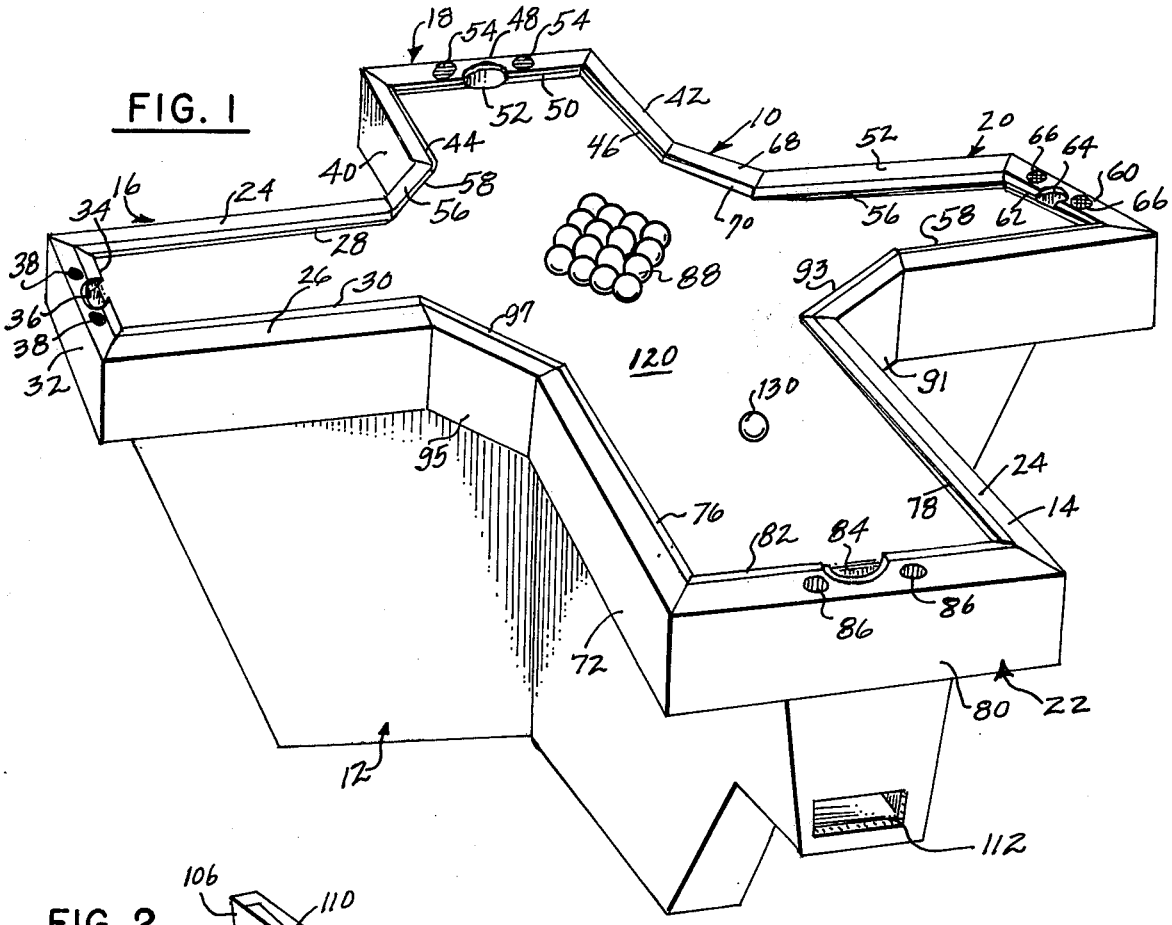
FIG. 1 is a view in perspective of a game table forming a part of the game of the present invention.

Referring now to the drawing and more particularly to FIG. 1, the game of the present invention includes a table generally indicated by reference numeral 10 and having a base 12 and a top 14 of generally cruciform configuration. The top 14 is desirably all one piece and has extremities 16, 18, 20 and 22, the extremities 16 and 20 being oppositely disposed and the extremities 18 and 22 being oppositely disposed as clearly illustrated in FIG. 1. The extremity 16 has side walls 24 and 26 provided with cushions 28 and 30, respectively and an end wall 32 provided with a cushion 34. Intermediate the ends of the cushion 34 is a pocket 36 of a characteristic color which may be represented by colored spots 38.

The extremity 18 has disposed side walls 40 and 42 provided with cushions 44 and 46, respectively, and an end wall 48 having a cushion 50 and a pocket 52 identified by color inserts 54.

Between the extremity 16 and the extremity 18 is a wall 56 having a cushion 58. The wall 56 extends at an angle to the side walls of each of the extremities 16 and 18 and cooperates with the rest of the structure in a manner hereafter apparent. The extremity 20 has opposed parallel side walls 52 and 54 provided with cushions 56 and 58 and an end wall 60 having a cushion 62 and a pocket 64 identified by color tab 66. A wall 68 extends angularly with respect to the walls 42 and 52 and has a cushion 70. The wall 68 forms a part of a generally square central zone as will be hereafter apparent. The extremity 22 has opposed parallel side walls 72 and 74 provided with cushions 76 and 78, respectively, and an end wall 80 having a cushion 82, a pocket 84 and identifying color tabs 86. A wall 91 extends in parallelism to the wall 56 and has a cushion 93. In like manner, a wall 95 joins the walls 26 and 72 and has a cushion 97. The wall 95 is parallel to the wall 68 while the wall 91 is parallel to the wall 56 as will be apparent.

The balls are indicated generally by reference numeral 88 and are illustrated as being racked with a generally square rack with the corners of the massed block of balls facing the pockets and the sides parallel with the walls defining the central zone.

Figure 2:
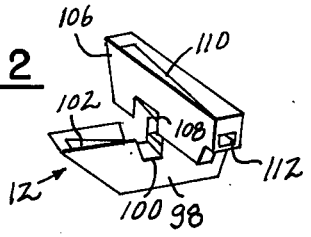
FIG. 2 is a greatly reduced exploded view in perspective of the leg assemblies forming a part of the game table of FIG. 1, the table top being removed for the sake of clarity.
Figure 3:
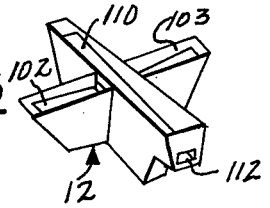
FIG. 3 illustrates the parts of FIG. 2 in assembled relation.

Referring now to FIGS. 2 and 3, the base 12 includes a first leg assembly 98 and is formed with a slot 100 and inclined troughs 102 and 103 for feeding balls received in pockets 36 and 64 to trough 110. The balls then roll down the inclined trough 110 to receptacle 112 where they may be retrieved. Shown in exploded relation in FIG. 2 is a leg sub-assembly 106 having a notch 108 and a trough 110 for feeding balls falling into the pocket 52 to a receptacle 112 in the near end of the sub-assembly 106. As shown best in FIG. 3, the notch 108 is received in notch 100 so that the sub-assemblies assume the relationship illustrated in FIG. 3 when assembled. In this relationship, the trough is clear, (trough 102) to transmit balls to the middle of the trough 102 when they are transferred to trough 110.

Figure 4:
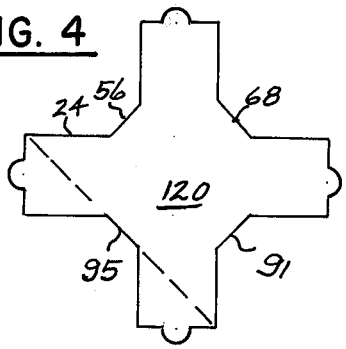
FIG. 4 is a plan view, greatly enlarged in FIG. 3, showing the relationship of the cushions to each other and the relationship of the central zone to the extremities.

In FIG. 4 is illustrated in plan view the relationship of the various walls, each to the other, and to the walls of the extremities. It will be noted that spaced parallel walls 56 and 91 cooperate with spaced parallel walls 68 and 95 to form a generally square central zone 120. It will be noted also that the walls defining the central zone are coincident with an imaginary line extending between the opposite corners of adjacent extremities.

Figure 5:
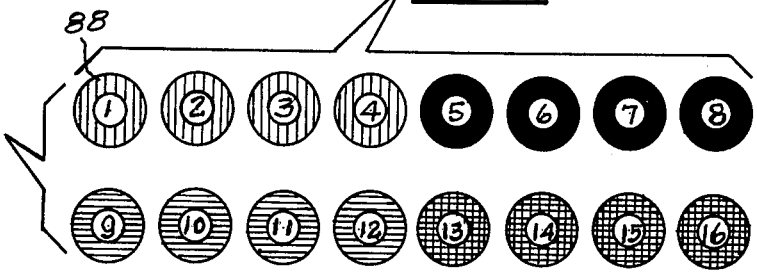
FIG. 5 is a view illustrating the balls of different colors.

FIG. 5 illustrates the balls 88 as comprising four distinct colors, balls 1–4 being one color, balls 5–8 being another color, balls 9–12 being a further color and balls 13–16 being a different color. Each player selects a color and the privilege of breaking his selected by chance. The player who wins this privilege then strikes cue ball 130 into the massed balls 88 and then attempts to successively strike balls of the color of tabs 86 into pocket 84. As mentioned previously, the balls may be struck rotationally, if desired.

I claim:

1. A game comprising a plurality of balls having a plurality of different colors, one color for each player, a game table of generally cruciform configuration having a pocket at the middle of each extremity or reception of the balls of a particular color, the game object being to place all the balls of a particular color in the pocket identified with the same color.

2. A game in accordance with claim 1 wherein the table has a base comprised of a pair of leg assemblies each notched for the reception of the other.

3. A game in accordance with claim 1 wherein the ends of said extremities are generally square in configuration and are provided with cushions and in which the extremities are joined by cushioned walls in parallel pairs to form a generally square central zone in which racked balls may be broken.

4. A game in accordance with claim 3 wherein a square rack is provided and adapted to be disposed with the sides thereof parallel to the walls of said central zone so that the massed balls when broken by a player will not accidentally fall into an opponent's pocket.

5. A game in accordance with claim 4 wherein each pocket is marked with one of four distinct colors each of which is chosen by a player who must propel the cue ball with a conventional cue stick to drop each ball of his color in the pocket of the same color.

6. A game comprising a plurality of balls having a plurality of different colors, one color for each player, a game table of generally cruciform configuration having a pocket in the middle of each extremity for reception of the balls of a particular color, said table having a base comprising a pair of leg assemblies each notched for reception of the other, each of said leg assemblies being provided with an inclined trough for feeding balls received in one of the pockets of each assembly down to a readily accessible receptacle, the game object being to place all of the balls of a particular color in the pocket identified with the same color.

7. A game in accordance with claim 6 wherein the balls received in the other pocket of each leg assembly is also received in said receptacle.

* * * * *